US011753275B2

(12) United States Patent
Mustonen et al.

(10) Patent No.: US 11,753,275 B2
(45) Date of Patent: Sep. 12, 2023

(54) METHOD FOR PREVENTIVE MAINTENANCE OF AN ELEVATOR AND AN ELEVATOR SYSTEM

(71) Applicant: KONE Corporation, Helsinki (FI)

(72) Inventors: Matti Mustonen, Helsinki (FI); Arttu Leppäkoski, Helsinki (FI); Ari Jussila, Helsinki (FI); Juha-Matti Aitamurto, Helsinki (FI)

(73) Assignee: KONE Corporation, Helsinki (FI)

( * ) Notice: Subject to any disclaimer, the term of this patent is extended or adjusted under 35 U.S.C. 154(b) by 1270 days.

(21) Appl. No.: 16/254,243

(22) Filed: Jan. 22, 2019

(65) Prior Publication Data

US 2019/0248625 A1 Aug. 15, 2019

(30) Foreign Application Priority Data

Feb. 15, 2018 (EP) ..... 18156867

(51) Int. Cl.
*B66B 5/00* (2006.01)

(52) U.S. Cl.
CPC ..... *B66B 5/0025* (2013.01); *B66B 5/0031* (2013.01); *B66B 5/0037* (2013.01)

(58) Field of Classification Search
CPC ..... B66B 1/28–32; B66B 1/3492; B66B 1/36; B66B 5/00; B66B 5/0006
See application file for complete search history.

(56) References Cited

U.S. PATENT DOCUMENTS 4,387,436 A * 6/1983 Katayama ..... B66B 1/3492 187/394
2005/0269163 A1 12/2005 Angst
2013/0118836 A1 5/2013 Rossignol
2015/0014098 A1 1/2015 Stölzl et al.
2015/0083528 A1* 3/2015 Kattainen ..... B66B 1/3492 187/393

FOREIGN PATENT DOCUMENTS

EP 2 527 281 A2 11/2012

OTHER PUBLICATIONS

European Search Report, issued in Priority Application No. 18156867.6, dated Jul. 27, 2018.

* cited by examiner

*Primary Examiner* — Christopher Uhlir
(74) *Attorney, Agent, or Firm* — Birch, Stewart, Kolasch & Birch, LLP

(57) ABSTRACT

A method for preventive maintenance of an elevator speed sensor system includes at least a first and a second sensor, which are independent of each other. The method includes: determining a reference distance for an elevator car travel between a first door zone and a second door zone, during the elevator car travel, defining continuously a first elevator car speed information from the first sensor and a second elevator car speed information from the second sensor, calculating a cumulative sensor system error by integrating the difference between the first elevator car speed information and the second elevator car speed information, and dividing the cumulative sensor system error with the reference distance to obtain a sensor system performance indicator.

20 Claims, 6 Drawing Sheets

METHOD FOR PREVENTIVE MAINTENANCE OF AN ELEVATOR AND AN ELEVATOR SYSTEM

TECHNICAL FIELD

The invention concerns in general the technical field of an elevator technology. Especially, the invention concerns solutions for preventive maintenance of an elevator movement sensor system.

BACKGROUND

An elevator comprises typically an elevator car and a hoisting machine configured to drive the elevator car in an elevator shaft between the door zones. For safety reasons the vertical position of the elevator car inside the elevator shaft in relation to the door zones, i.e. absolute positioning, may be needed to be defined under certain conditions. In some circumstances the absolute position information may need to be known with an accuracy of approximately 10 mm. Examples of that kind of conditions may be elevators having reduced stroke buffers or in elevators used in a certain geographical location. Furthermore, the absolute positioning may be useful when implementing some safety functions of an elevator. In order to enhance the safety of an elevator system, the absolute positioning may be implemented to be independent from a drive control system of the elevator.

Preferably, the absolute positioning may be implemented by means of a component that fulfills the accuracy requirements. A Safety Integrity Level (SIL) may be used to indicate a tolerable failure rate of a particular safety function, for example a safety component. SIL is defined as a relative level of risk-reduction provided by the safety function, or to specify a target level of risk reduction. SIL has a number scheme from 1 to 4 to represent its levels. The higher the SIL level is, the greater the impact of a failure is and the lower the failure rate that is acceptable is.

Accordingly, there is a need to ensure operating condition of the absolute positioning solutions in an elevator system.

SUMMARY

An objective of the invention is to monitor operating condition of the elevator speed sensor system to ensure continuous operation without elevator service interruptions.

A first aspect of the invention is a method for preventive maintenance of an elevator speed sensor system comprising at least a first and a second sensor, which are independent of each other, the method comprising: determining a reference distance for an elevator car travel between a first door zone and a second door zone. During an elevator car travel between a first door zone and a second door zone, defining continuously a first elevator car speed information from the first sensor and a second elevator car speed information from the second sensor, calculating a cumulative sensor system error by integrating the difference between the first elevator car speed information and the second elevator car speed information, dividing the cumulative sensor system error with the reference distance to obtain a sensor system performance indicator.

This can mean that operating condition of a speed sensor system (which preferably also acts as an absolute positioning sensor system of an elevator) can be monitored and maintenance can be performed to calibrate or repair the sensor system before it fails. A defective absolute positioning sensor system would mean that elevator has to be taken out of service, thus causing service interruption and therefore discomfort to elevator passengers.

A second aspect of the invention is an elevator system comprising an elevator car, a hoisting machine with a hoisting motor to drive the elevator car and a speed sensor system comprising at least a first sensor and a second sensor for measuring movement of the elevator car. The elevator system further comprises: an elevator control apparatus, which elevator control apparatus is connected to the first sensor and the second sensor, and which elevator control apparatus has a remote connection interface to the maintenance server. The elevator control apparatus is configured to perform a method according to the first aspect of the invention for preventive maintenance of the elevator system.

According to an embodiment of the first aspect of the invention: obtaining supply frequency of elevator hoisting motor during the elevator car travel continuously from motor controller of the elevator hoisting machine and defining a third elevator car speed information therefrom, comparing the first elevator car speed information and the second elevator car speed information with the third elevator car speed information, and based on the comparison, adding a sensor identification to the sensor system performance indicator. This can mean that the particular sensor needing maintenance (for example calibration or moderate repair work) may be identified and the established service request may include identification of this sensor, thereby facilitating the maintenance work.

According to an embodiment of the first aspect of the invention: transmitting the sensor system performance indicator to a maintenance server, in the maintenance server, establishing a service request based on a sensor system performance indicator or on a sequence of sensor system performance indicators, the service request being established before the speed sensor system is considered as defective, and transmitting the service request to a maintenance service unit.

According to an embodiment of the first aspect of the invention: calculating statistics information from a set of performance indicators, transmitting the statistics information to a maintenance server, in the maintenance server, establishing a service request based on the statistics information, the service request being established before the speed sensor system is considered as defective, and transmitting the service request to a maintenance service unit. This can mean that statistics information can be generated on elevator site and transmitted to a maintenance server only periodically, thus reducing data transfer between elevator and maintenance server. Further, it is possible to use several consecutive pieces of statistics information to detect trend(s) in sensor system operating condition, which improves sensor system diagnostics and helps in scheduling the service requests.

According to an embodiment of the first aspect of the invention, the first sensor is a first pulse sensor unit providing a pulse position information of the traction sheave of the hoisting machine of the elevator car, the first pulse sensor unit comprising: at least one magnetic sensor measuring magnetic field variation from a rotating magnet ring arranged in the traction sheave of the hoisting machine.

According to an embodiment of the first aspect of the invention, the second sensor is a second pulse sensor unit providing a pulse position information of the elevator car, the second pulse sensor unit comprising: at least one quadrature sensor measuring incremental pulses from a rotating magnet ring arranged in an overspeed governor arranged in the elevator shaft.

According to an embodiment of the first aspect of the invention, the floor number, identification code, magnet type, and the linear position of the elevator car within the door zone is obtained from at least one door zone sensor unit comprising at least one Hall sensor and a RFID reader.

According to an embodiment of the first aspect of the invention, calculating a reference distance for an elevator car travel between a first door zone and a second door zone comprises: obtaining and storing a pre-information about at least one door zone magnet at a door zone of each floor of an elevator shaft during a setup run, the pre-information comprising the following: floor number, identification code, magnet type, pulse position information, linear position information, and calculating the reference distance between the door zones by using the pre-information.

The exemplary embodiments of the invention presented in this patent application are not to be interpreted to pose limitations to the applicability of the appended claims. The verb "to comprise" is used in this patent application as an open limitation that does not exclude the existence of also un-recited features. The features recited in depending claims are mutually freely combinable unless otherwise explicitly stated.

The novel features which are considered as characteristic of the invention are set forth in particular in the appended claims. The invention itself, however, both as to its construction and its method of operation, together with additional objectives and advantages thereof, will be best understood from the following description of specific embodiments when read in connection with the accompanying drawings.

BRIEF DESCRIPTION OF FIGURES

The embodiments of the invention are illustrated by way of example, and not by way of limitation, in the figures of the accompanying drawings.

DESCRIPTION OF SOME EMBODIMENTS

Figure 1A:
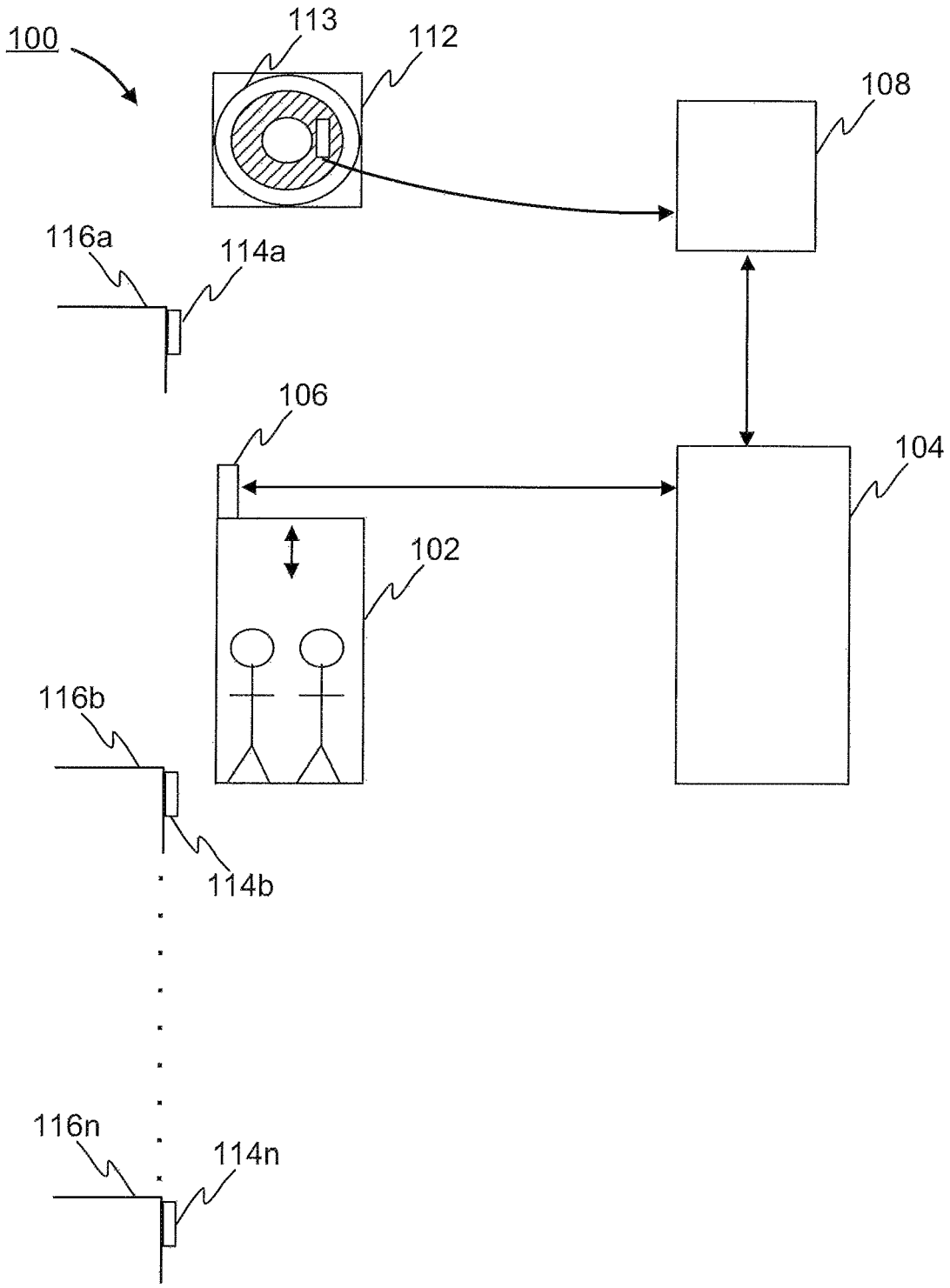
FIGS. 1A, 1B illustrate altogether schematically an elevator system according to the invention.

FIG. 1A illustrates schematically an elevator system 100, wherein the embodiments of the invention may be implemented as will be described. The elevator system 100 comprises an elevator car 102, a safety control unit 104, at least one door zone sensor unit 106, a pulse sensor unit 108, and an overspeed governor (OSG) 112. The at least one door zone sensor unit 106 may be fixed to the elevator car 102, for example on the roof of the elevator car 102, as the door zone sensor unit 106 in FIG. 1A. Alternatively, the at least one door zone sensor unit 106 may be fixed below the floor of the elevator car 102 or to a door frame of the elevator car 102. In FIG. 1A the elevator car 102 is moving in vertical direction inside an elevator shaft (not shown in FIG. 1A) by means of a hoisting machine (not shown in FIG. 1A). The pulse sensor unit 108 and the at least one door zone sensor unit 106 are communicatively coupled to the safety control unit 104. The communicatively coupling may be provided via an internal bus, for example. Preferably, the communicatively coupling may be provided via a serial bus.

Furthermore, the elevator system 100 comprises at least one door zone magnet 114*a*-114*n* at a door zone of each floor of the elevator shaft. The at least one door zone magnet 114*a*-114*n* is fixed to the elevator shaft. Preferably, the at least one magnet 114*a*-114*n* may be fixed to a landing door frame in the elevator shaft. The door zone may be defined as a zone extending from a lower limit below floor level 116*a*-116*n* to an upper limit above the floor level 116*a*-116*n* in which the landing and car door equipment are in mesh and operable. The door zone may be determined to be from −400 mm to +400 mm for example. Preferably, the door zone may be from −150 mm to +150 mm. Alternatively or in addition, the elevator system 100 according to the invention may comprise at least one terminal magnet at least at one terminal floor of the elevator shaft. The at least one terminal floor may be the top or the bottom floor. Each magnet may comprise at least one passive RFID tag. The at least one RFID tag comprises unique identification code (UID) and type code of the magnet.

Additionally, for safety reasons elevator system may comprise an overspeed governor (OSG) 112 arranged in the elevator shaft to stop the movement of the elevator car 102, if the elevator car 102 speed meets a predefined speed limit. The OSG 112 may comprise a sheave 113 rotated by a governor rope (not shown in FIG. 1A) that forms a closed loop and is coupled to the elevator car 102 so that the rope moves with the elevator car 102. The governor sheave 113 may be for example at the upper end of the governor rope loop and is coupled to an actuation mechanism that reacts to the speed of the elevator car 102. In some alternative embodiments, the OSG 112 may be mounted to elevator car 102.

Figure 4:
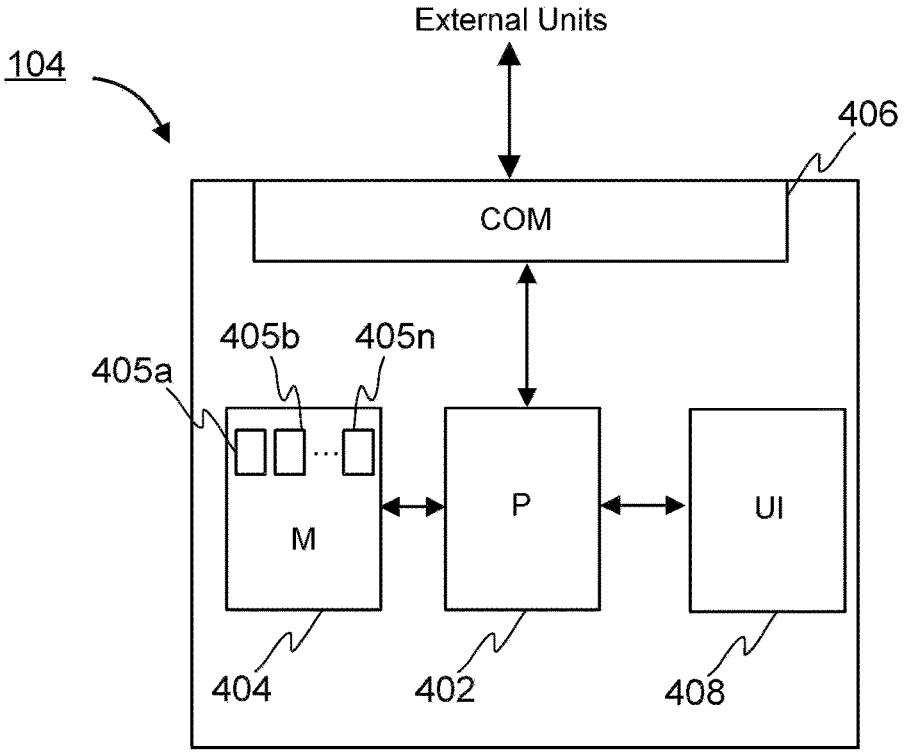
FIG. 4 illustrates schematically an example of a safety control unit according to the invention.

A schematic example of the safety control unit 104 according to the invention is disclosed in FIG. 4. The safety control unit 104 may comprise one or more processors 402, one or more memories 404 being volatile or non-volatile for storing portions of computer program code 405*a*-405*n* and any data values, a communication interface 406 and possibly one or more user interface units 408. The mentioned elements may be communicatively coupled to each other with e.g. an internal bus. The communication interface 406 provides interface for communication with any external unit, such as pulse sensor unit 108, door zone sensor unit 106, database and/or external systems. The communication interface 406 may be based on one or more known communication technologies, either wired or wireless, in order to exchange pieces of information as described earlier.

The processor 402 of the safety control unit 104 is at least configured to implement at least some method steps as described. The implementation of the method may be achieved by arranging the at least one processor 402 to execute at least some portion of computer program code 405*a*-405*n* stored in the memory 404 causing the one processor 402, and thus the safety control unit 104, to implement one or more method steps as described. The processor 402 is thus arranged to access the memory 404 and retrieve and store any information therefrom and thereto. For sake of clarity, the processor 402 herein refers to any unit suitable for processing information and control the operation of the safety control unit 104, among other tasks. The operations may also be implemented with a microcontroller solution with embedded software. Similarly, the memory 404 is not limited to a certain type of memory only, but any memory type suitable for storing the described pieces of information may be applied in the context of the present invention.

Figure 5:
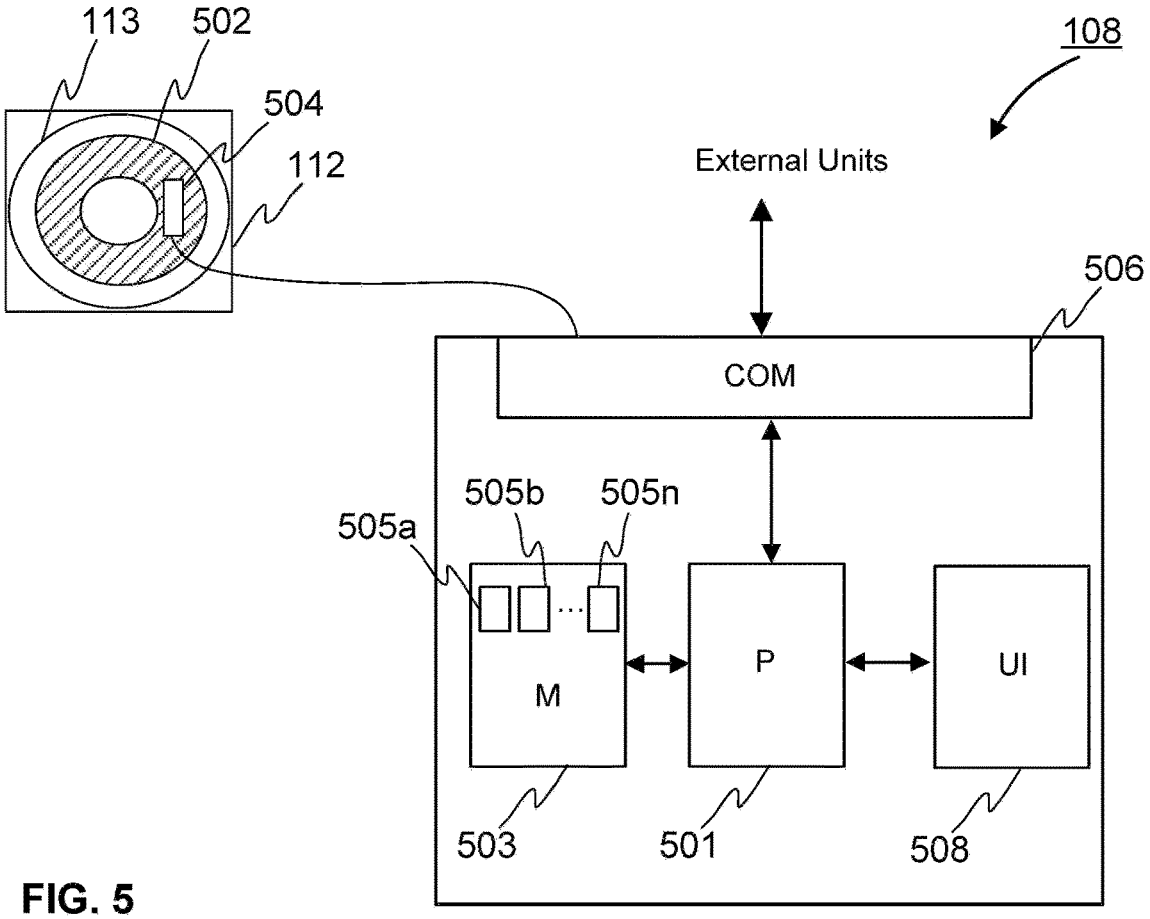
FIG. 5 illustrates schematically an example of the pulse sensor unit according to the invention.

As described the pulse position information of the elevator car 102 may be obtained from the pulse sensor unit 108. A schematic example of the pulse sensor unit 108 according to the invention is disclosed in FIG. 5. In addition, FIG. 5 illustrates at least some of the relating components implemented to measure the pulse position information of the elevator car 102. The related components comprise the OSG 112 and a magnet ring 502 arranged in OSG 112. Alternatively, the magnet ring may also be arranged in a roller guide. The pulse sensor unit 108 may comprise at least one quadrature sensor 504, one or more processors 501, one or more memories 503 being volatile or non-volatile for storing portions of computer program code 505*a*-505*n* and any data values, a communication interface 506 and possibly one or more user interface units 508. The mentioned elements may be communicatively coupled to each other with e.g. an internal bus. The at least one quadrature sensor 504 is configured to measure incremental pulses from the rotating magnet ring 502 arranged in OSG 112 arranged in the elevator shaft. The magnetic ring 502 may comprise alternating evenly spaced north and south poles around its circumference. The at least one quadrature sensor 504 may be a Hall sensor, for example. Furthermore, the at least one quadrature sensor 504 has an A/B quadrature output signal for the measurement of magnetic poles of the magnet ring 502. Furthermore, the at least one quadrature sensor 504 may be configured to detect changes in the magnetic field as the alternating poles of the magnet pass over it. The output signal of the quadrature sensor may comprise two channels A and B that may be defined as pulses per revolution (PPR). Furthermore, the position in relation to the starting point in pulses may be defined by counting the number of pulses. Since, the channels are in quadrature more, i.e. 90 degree phase shift relative to each other, also the direction the of the rotation may be defined. The communication interface 506 provides interface for communication with the at least one quadrature sensor 504 and with any external unit, such as safety control unit 104, door zone sensor unit 106, database and/or external systems. The communication interface 506 may be based on one or more known communication technologies, either wired or wireless, in order to exchange pieces of information as described earlier.

The processor 501 of the pulse sensor unit 108 is at least configured to obtain the quadrature signal from the at least one quadrature sensor, define the pulse position information based on the quadrature signals and to store the defined pulse position information into the memory 503. The processor 502 is thus arranged to access the memory 504 and retrieve and store any information therefrom and thereto. For sake of clarity, the processor 501 herein refers to any unit suitable for processing information and control the operation of the pulse sensor unit 108, among other tasks. The operations may also be implemented with a microcontroller solution with embedded software. Similarly, the memory 503 is not limited to a certain type of memory only, but any memory type suitable for storing the described pieces of information may be applied in the context of the present invention. The pulse sensor unit 108 may be a separate unit communicatively coupled to the safety control unit 104. Alternatively, the pulse sensor unit 108 may be implemented as part of the safety control unit 104 or the pulse sensor unit may be implemented as an additional circuit board operating as an interface between the at least one quadrature sensor 504 and the safety control unit 104.

Figure 6:
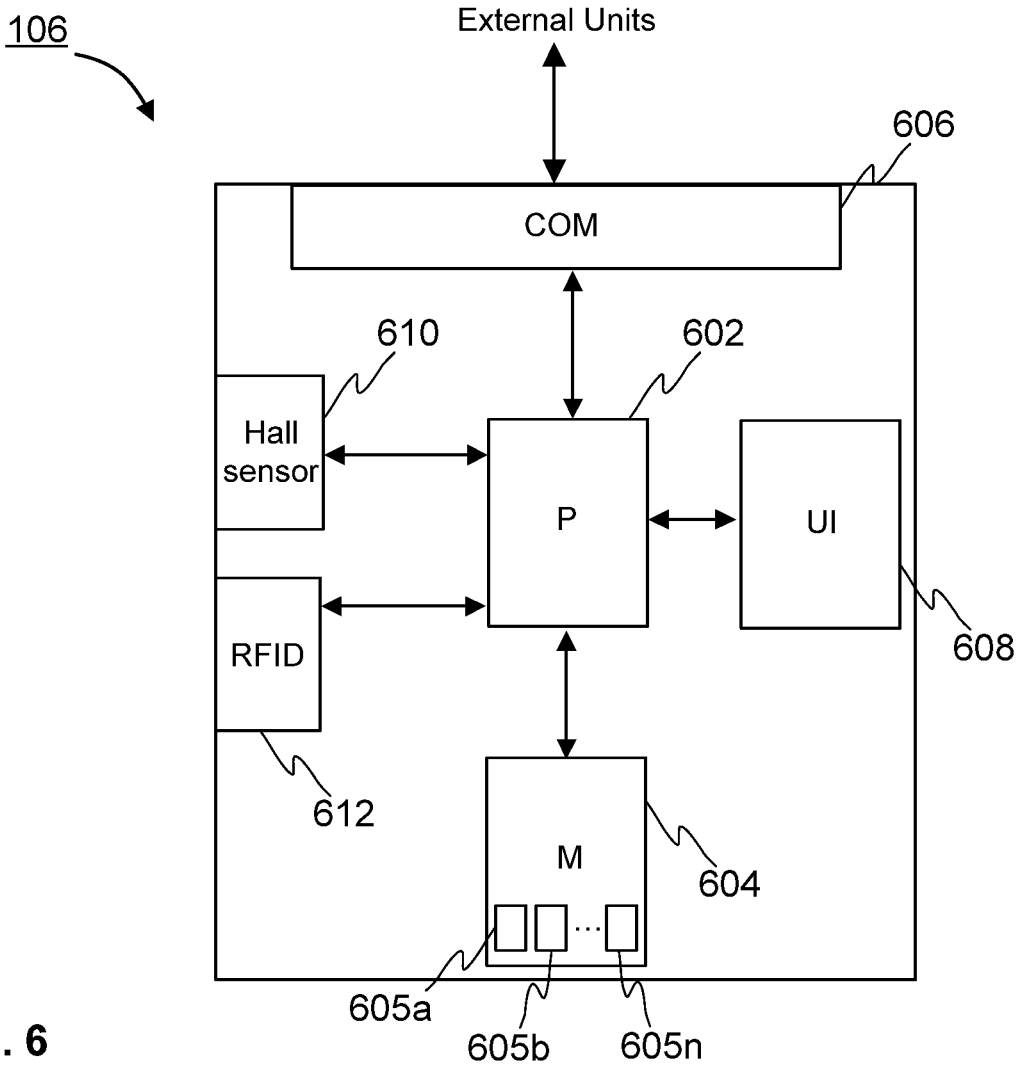
FIG. 6 illustrates schematically an example of the door zone sensor unit according to the invention.

As described at least the linear position information of the elevator car 102 may be obtained from at least one door zone sensor unit 106. Preferably, one door zone sensor unit 106 may be provided for each elevator car door. A schematic example of the at least one door zone sensor unit 106 according to the invention is disclosed in FIG. 6. The door zone sensor unit 106 may comprise at least one Hall sensor 610, RFID reader 612, one or more processors 602, one or more memories 604 being volatile or non-volatile for storing portions of computer program code 605*a*-605*n* and any data values, a communication interface 606 and possibly one or more user interface units 608. The mentioned elements may be communicatively coupled to each other with e.g. an internal bus. The communication interface 606 provides interface for communication with any external unit, such as elevator control unit, safety control unit 104, pulse sensor unit 108, database and/or external systems. The communication interface 606 may be based on one or more known communication technologies, either wired or wireless, in order to exchange pieces of information as described earlier. The at least one Hall sensor 610 may be an internal unit as in shown in FIG. 6. Alternatively or in addition, the at least one Hall sensor 610 may be an external unit. Furthermore, the RFID reader 612 may be an internal unit of the door zone sensor unit 106. Alternatively or in addition, the RFID reader 612 may be an external unit.

The processor 602 of the door zone sensor unit 106 is at least configured to provide at least the following door zone information within the door zone of each floor: floor number, magnet type, identification code of the magnet, linear position of the elevator car, speed of the elevator car. The at least one Hall sensor 610 of the door zone sensor unit 106 is configured to obtain the strength of magnetic field as the elevator car 102 bypassing the at least one door zone magnet 114*a*-114*n* at the door zone. Based on the obtained magnetic field strength at least the linear position and the speed of the elevator car 102 within the door zone may be defined. For example, the speed of the elevator car 102 may be defined from a rate of change of the linear position of the elevator car 102 defined from the obtained strength of magnetic field as the elevator car 102 bypasses the at least one door zone magnet 114*a*-114*n* at the door zone. The number of Hall sensors 610 may be determined based on the number of the door zone magnets 114*a*-114*n* at the door zone of each floor 116*a*-116*n*. The RFID reader 612 of the door zone sensor unit 106 is configured to obtain at least the floor number, magnet type and identification code of the magnet from the RFID tag of the at least one door zone magnet 114*a*-114*n*. The door zone information may be obtained only within the door zone of each floor of the elevator shaft.

The processor 602 is arranged to access the memory 604 and retrieve and store any information therefrom and thereto. For sake of clarity, the processor 602 herein refers to any unit suitable for processing information and control the operation of the door zone sensor unit 106, among other tasks. The operations may also be implemented with a microcontroller solution with embedded software. Similarly, the memory 604 is not limited to a certain type of memory only, but any memory type suitable for storing the described pieces of information may be applied in the context of the present invention.

The absolute position information of the elevator car 102 may be defined substantially accurately by means of the method, safety control unit and elevator system as described above. Alternatively or in addition, the absolute position information of the elevator car 102 may be defined at two channels in order to certainly meet the SIL3 level accuracy requirements. In order to define two-channel absolute position information the pulse position information and door zone information may be obtained at two channels. The two-channel pulse position information may be obtained from of the pulse sensor unit 108 comprising one quadrature sensor and at least one processor at each channel. Furthermore, the two-channel door zone information may be obtained from the door zone sensor unit 106 comprising at least one Hall sensor and at least one processor at each channel. The above presented method safety control unit, and elevator system may be implemented for two channels similarly as described above for one channel.

Figure 1B:
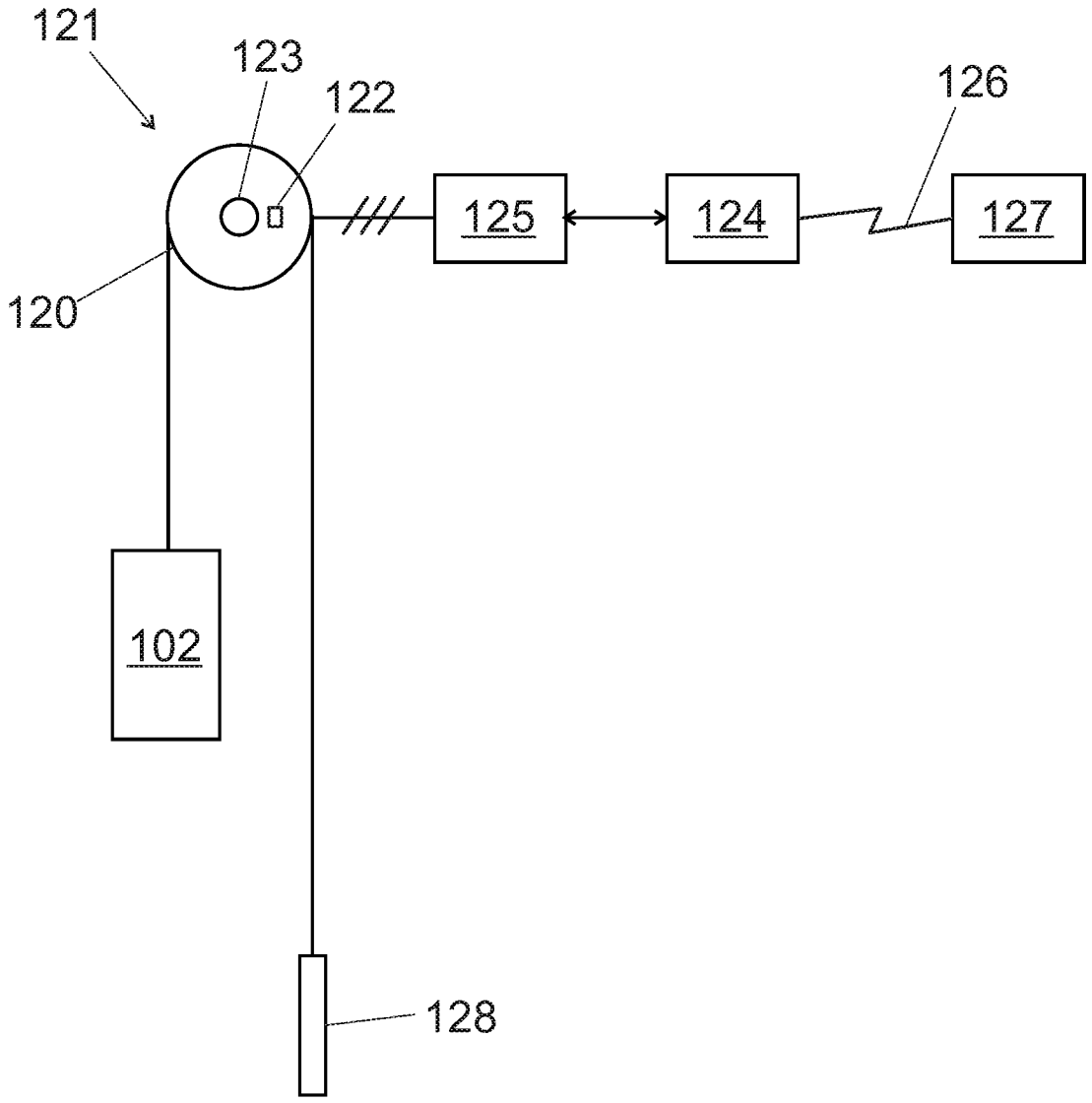

Turning to FIG. 1B, the elevator system 100 of FIG. 1A further comprises a hoisting machine 120 with a hoisting motor (not shown in FIG. 1B) to drive the elevator car 102 and counterweight 128 and a speed sensor system comprising at least a first pulse sensor unit 121 and a second pulse sensor unit 108, which was already disclosed in connection with FIG. 1A. First 121 and second 108 pulse sensor units are adapted to measure speed and position of the elevator car 102.

The first sensor is a pulse sensor unit 121 providing a pulse position information of the traction sheave of the hoisting machine 120 of the elevator car. The pulse sensor unit 121 comprises a magnetic sensor 122 measuring magnetic field variation from a rotating magnet ring 123 arranged in the traction sheave of the hoisting machine.

The first sensor 121 and the second sensor 108 are independent of each other, which means that failure of one sensor does not directly affect the other sensor. Thus, a reciprocal comparison of sensor readings of the separate sensors 121, 108 may provide information about operating condition of the sensor(s) 121, 108.

The elevator system 100 further comprises a drive unit 125, which is configured to supply electric power to the hoisting motor to drive elevator car 102. The elevator system 100 also has an elevator control unit 124, which is responsible of receiving car calls from elevator passengers and which also commands drive unit 124 such that elevator car can serve the generated car calls. Therefore elevator control unit 124 also monitors elevator car movement in elevator shaft. Accordingly, elevator control unit is connected to the pulse sensor units 108, 121.

Figure 2:
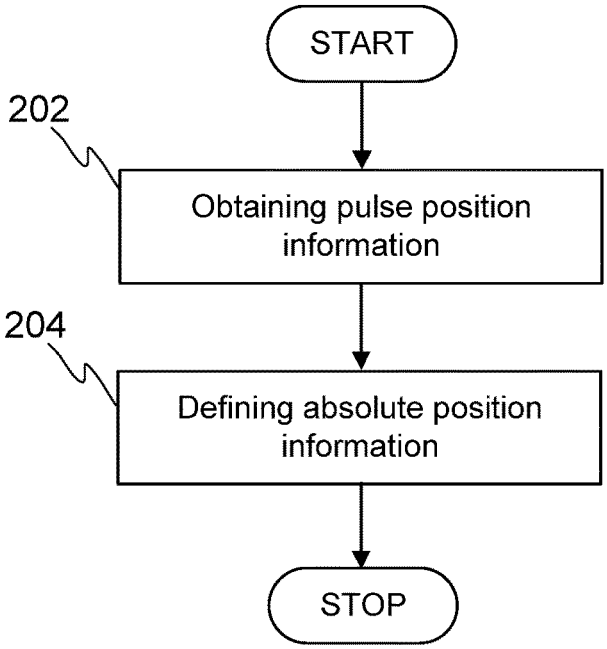
FIG. 2 illustrates schematically an example of a method according to the invention.
Figure 3A:
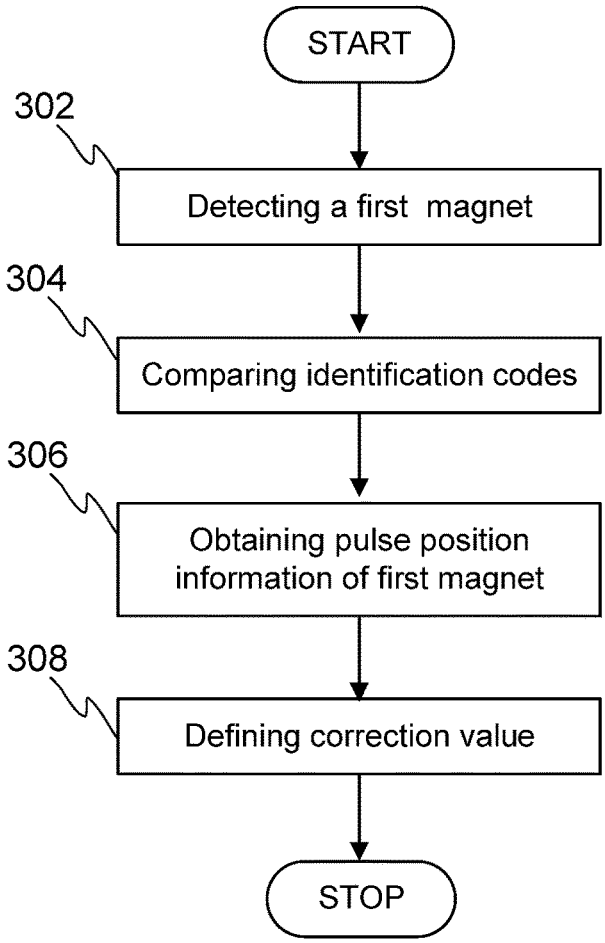
FIG. 3A illustrates schematically an example of a synchronization run according to the invention.
Figure 3B:
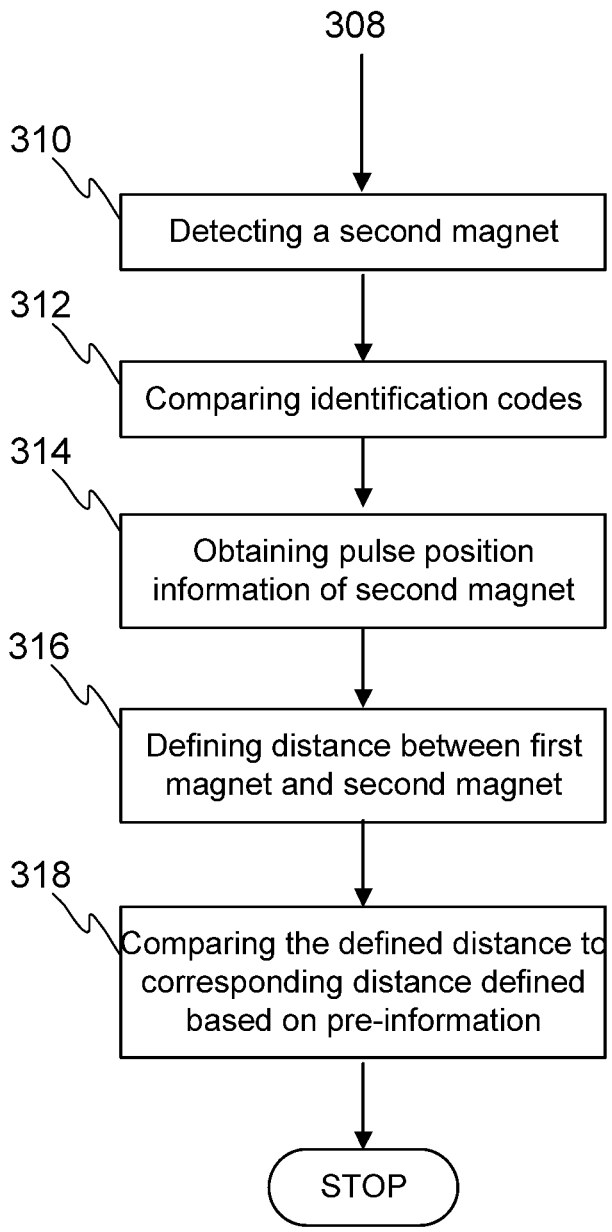
FIG. 3B illustrates schematically an example of further steps of a synchronization run according to the invention.

FIG. 2 illustrates schematically an example of a method for determining elevator car position with the second sensor 108 in combination with the door zone magnets as a flow chart. A pulse position information of an elevator car 102 is obtained at the step 202. The pulse position information may be obtained continuously regardless of the place of the elevator car in the elevator shaft. The pulse position information may be obtained from the pulse sensor unit 108 as will be described later. In the context of this application the pulse position information means a position information of the elevator car in pulses. At the step 204 an absolute position information of the elevator car 102 is defined by adding a predefined correction value to the obtained pulse position information of the elevator car. The predefined correction value indicates a drift between the obtained pulse position information of the elevator car 102 and the actual pulse position of the elevator car 102. The correction value may be defined during a synchronization run as will be described later. Furthermore, the absolute position information of the elevator car 102 may be scaled into some common unit system, such as SI-units, by dividing the defined absolute position value by a predefined scaling factor. The scaling factor may be defined during a setup run as will be described later.

Further, data received from the pulse sensor units 108, 121, it processed and memorized in the elevator control unit 124 for maintenance purposes. As pictured in FIG. 1B, elevator control unit 124 is connected to a remote maintenance server 127 via a remote connection interface 126, and at certain time intervals elevator control unit 124 sends processed maintenance data to the maintenance server 127. In the maintenance server, preventive maintenance of the movement sensor system (including the pulse sensor units 108, 121 as well as related cabling, processing units etc.) is then carried out as disclosed hereinafter. Preventive maintenance means that maintenance actions may be taken already before failure of the pulse sensor units 108, 121 is detected, thus preventing elevator service interruptions.

As mentioned above, elevator control unit 124 receives pulse position information during elevator travel continuously from the pulse sensor units 108, 121. A reference distance xref for an elevator car travel between different door zones is calculated and memorized during setup run. The setup run is performed before the elevator car 102 may be taken into actual operation. During the setup run the elevator car 102 may be configured to drive first either at the top floor or at the bottom floor and then the elevator car 102 is configured to drive the elevator shaft from one end to the other end. The setup run may comprise obtaining and storing pre-information about the at least one door zone magnet 114*a*-114*n* at the door zone of each floor of the elevator shaft. The pre-information may be stored in a non-volatile memory of the safety control unit. The pre-information may comprise at least the following: floor number, identification code, magnet type, pulse position information, linear position information. The linear position information of the elevator car within the door zone, the floor number, identification code, and magnet type may be obtained from the door zone sensor unit 106 comprising at least one Hall sensor and RFID reader as will be described later. The pulse position information may be obtained from the pulse sensor unit 108 as will be described later. The pulse position information and linear position information may be obtained at mid-point of each door zone magnet.

The reference distance xref is calculated from the pre-information as a distance between consecutive door zones in the shaft.

During an elevator car travel between a first and a second selected door zones, a first elevator car speed information v1 is determined continuously from the pulse position information of the first pulse sensor unit 121 and a second elevator car speed information v2 is determined continuously from the pulse position information of the second pulse sensor unit 108. This may be done by measuring number of pulses in a certain time interval or by measuring time difference between consecutive pulses, for example.

A cumulative sensor system error is calculated by integrating the difference between the first elevator car speed information v1 and the second elevator car speed information v2. This cumulative sensor system error is further divided with the reference distance xref to obtain a sensor system performance indicator Kp as a relative value, which is easier to process in the data analytics in the maintenance server 127. The sensor system performance indicator Kp calculation process may be represented with an equation as follows:

$$Kp = \frac{\int (v1 - v2)dt}{xref}$$

In first embodiment, the calculated sensor system performance indicators Kp are first memorized in the elevator control unit 124. In selected time intervals, e.g. once a day, the performance indicators Kp are transferred to the maintenance server 127. In the maintenance server, a sequence of consequent performance indicators is processed to identify e.g. growing trends which would give an indication of maintenance need of the pulse sensor system 108, 121. When maintenance need is determined, service request is established in the maintenance server 127, preferably already before the pulse sensor system is considered as defective. The service request scheduled and transmitted to a suitable maintenance unit (having required knowledge and a corresponding geographical location) such that maintenance can be done before the pulse sensor system fails.

In a second embodiment, statistics information is calculated in the elevator control unit 124 from the sensor system performance indicators Kp before they are sent to the maintenance server 127. In the maintenance server, the statistics information is then used instead of (or in addition to) the separate performance indicators to determine maintenance need. This may be advantageous such that non-relevant variation between separate sensor system performance indicators Kp may be omitted.

In some refinements, elevator control unit 124 also reads during elevator car travel continuously the supply frequency of the elevator hoisting motor of the hoisting machine 120 from the drive unit 125 and defines a third elevator car speed information therefrom. By comparing the first elevator car speed information v1 from the first pulse sensor unit 121 and the second elevator car speed information v2 from the second pulse sensor unit 108 with the third elevator car speed information, it is possible to define which sensor 108, 121 is defective and add this sensor identification information to the sensor system performance indicator Kp.

The present invention as hereby described provides great advantages over the prior art solutions. For example, the present invention improves at least partly the safety of the elevators. The present invention enables implementation of diagnosis and preventive maintenance of an absolute positioning by using already existing door zone sensor unit, elevator control unit and safety control unit together with additional substantially inexpensive components, such as magnet ring in OSG, and a pulse sensor unit comprising at least one quadrature sensor. The total costs of the additional components may be substantially less than the total costs of the prior art solutions. Moreover, in the present invention the travelling height is not limited, because the absolute position information may be defined continuously regardless of the place of the elevator car in the elevator shaft without any expensive magnetic tape or similar extending from end to end of the elevator shaft. Furthermore, the present invention enables two-channel absolute positioning for SIL3 safety integrity level that may be required for many safety functions in an elevator system.

The verb "meet" in context of an SIL3 level is used in this patent application to mean that a predefined condition is fulfilled. For example, the predefined condition may be that the SIL3 level accuracy limit is reached and/or exceeded.

This invention is also useful for many different kind of elevators, such as counterweightless elevators, multicar elevators, high-rise elevators, elevators propelled with linear motors, et cetera.

The specific examples provided in the description given above should not be construed as limiting the applicability and/or the interpretation of the appended claims. Lists and groups of examples provided in the description given above are not exhaustive unless otherwise explicitly stated.

The invention claimed is:

1. A method for preventive maintenance of an elevator speed sensor system comprising at least a first and a second sensor, which are independent of each other, the method comprising:

determining a reference distance for an elevator car travel between a first door zone and a second door zone;

during an elevator car travel between the first door zone and the second door zone, defining continuously first elevator car speed information from the first sensor and second elevator car speed information from the second sensor;

calculating a cumulative sensor system error by integrating a difference between the first elevator car speed information and the second elevator car speed information; and dividing the cumulative sensor system error with the reference distance to obtain a sensor system performance indicator.

2. The method according to claim 1, comprising:

obtaining supply frequency of an elevator hoisting motor during the elevator car travel continuously from a motor controller of a hoisting machine of the elevator car and defining third elevator car speed information therefrom;

comparing the first elevator car speed information and the second elevator car speed information with the third elevator car speed information; and based on the comparison, adding a sensor identification to the sensor system performance indicator.

3. The method according to claim 1, comprising:

transmitting the sensor system performance indicator to a maintenance server;

in the maintenance server, establishing a service request based on a sensor system performance indicator or on a sequence of sensor system performance indicators, the service request being established before the speed sensor system is considered as defective; and transmitting the service request to a maintenance service unit.

4. The method according to claim 1, comprising:

calculating statistics information from a set of performance indicators;

transmitting the statistics information to a maintenance server;

in the maintenance server, establishing a service request based on the statistics information, the service request being established before the speed sensor system is considered as defective; and transmitting the service request to a maintenance service unit.

5. The method according to claim 1, wherein the first sensor is a first pulse sensor unit providing pulse position information of a traction sheave of a hoisting machine of the elevator car, the first pulse sensor unit comprising:

at least one magnetic sensor measuring magnetic field variation from a rotating magnet ring arranged in the traction sheave of the hoisting machine.

6. The method according to claim 1, wherein the second sensor is a pulse sensor unit providing pulse position information of the elevator car, the pulse sensor unit comprising:

at least one quadrature sensor measuring incremental pulses from a rotating magnet ring arranged in an overspeed governor arranged in an elevator shaft.

7. The method according to claim 1, wherein a floor number, identification code, magnet type, and a linear position of the elevator car within a door zone of the first and second door zones is obtained from at least one door zone sensor unit comprising at least one Hall sensor or a RFID reader.

8. The method according to claim 7, wherein calculating a reference distance for an elevator car travel between a first door zone and a second door zone comprises:

obtaining and storing a pre-information about at least one door zone magnet at a door zone of each floor of an elevator shaft during a setup run, the pre-information comprising the following: floor number, identification code, magnet type, pulse position information, linear position information; and calculating the reference distance between the door zones by using the pre-information.

9. An elevator system comprising:

an elevator car;

a hoisting machine with a hoisting motor to drive the elevator car;

a speed sensor system comprising at least a first sensor and a second sensor for measuring movement of the elevator car; and an elevator control apparatus, wherein the elevator control apparatus is connected to the first sensor and the second sensor, wherein the elevator control apparatus has a remote connection interface to a maintenance server, and wherein the elevator control apparatus is configured to perform the method according to claim 1 for preventive maintenance of the elevator system.

10. The method according to claim 2, comprising:

transmitting the sensor system performance indicator to a maintenance server;

in the maintenance server, establishing a service request based on a sensor system performance indicator or on a sequence of sensor system performance indicators, the service request being established before the speed sensor system is considered as defective; and transmitting the service request to a maintenance service unit.

11. The method according to claim 2, comprising:

calculating statistics information from a set of performance indicators;

transmitting the statistics information to a maintenance server;

in the maintenance server, establishing a service request based on the statistics information, the service request being established before the speed sensor system is considered as defective; and transmitting the service request to a maintenance service unit.

12. The method according to claim 3, comprising:

calculating statistics information from a set of performance indicators;

transmitting the statistics information to a maintenance server;

in the maintenance server, establishing a service request based on the statistics information, the service request being established before the speed sensor system is considered as defective; and transmitting the service request to a maintenance service unit.

13. The method according to claim 2, wherein the first sensor is a first pulse sensor unit providing pulse position information of a traction sheave of the hoisting machine of the elevator car, the first pulse sensor unit comprising:

at least one magnetic sensor measuring magnetic field variation from a rotating magnet ring arranged in the traction sheave of the hoisting machine.

14. The method according to claim 3, wherein the first sensor is a first pulse sensor unit providing pulse position information of a traction sheave of a hoisting machine of the elevator car, the first pulse sensor unit comprising:

at least one magnetic sensor measuring magnetic field variation from a rotating magnet ring arranged in the traction sheave of the hoisting machine.

15. The method according to claim 4, wherein the first sensor is a first pulse sensor unit providing pulse position information of a traction sheave of a hoisting machine of the elevator car, the first pulse sensor unit comprising:

at least one magnetic sensor measuring magnetic field variation from a rotating magnet ring arranged in the traction sheave of the hoisting machine.

16. The method according to claim 2, wherein the second sensor is a pulse sensor unit providing pulse position information of the elevator car, the pulse sensor unit comprising:

at least one quadrature sensor measuring incremental pulses from a rotating magnet ring arranged in an overspeed governor arranged in a elevator shaft.

17. The method according to claim 3, wherein the second sensor is a pulse sensor unit providing pulse position information of the elevator car, the pulse sensor unit comprising:

at least one quadrature sensor measuring incremental pulses from a rotating magnet ring arranged in an overspeed governor arranged in a elevator shaft.

18. The method according to claim 4, wherein the second sensor is a pulse sensor unit providing pulse position information of the elevator car, the pulse sensor unit comprising:

at least one quadrature sensor measuring incremental pulses from a rotating magnet ring arranged in an overspeed governor arranged in a elevator shaft.

19. The method according to claim 5, wherein the second sensor is a second pulse sensor unit providing pulse position information of the elevator car, the second pulse sensor unit comprising:

at least one quadrature sensor measuring incremental pulses from a rotating magnet ring arranged in an overspeed governor arranged in a elevator shaft.

20. The method according to claim 2, wherein a floor number, identification code, magnet type, and a linear position of the elevator car within a door zone of the first and second door zones is obtained from at least one door zone sensor unit comprising at least one Hall sensor or a RFID reader.

* * * * *